US005950740A

United States Patent [19]

Fletcher

[11] Patent Number: 5,950,740

[45] Date of Patent: Sep. 14, 1999

[54] SOIL SAMPLING APPARATUS

[76] Inventor: Steve D. Fletcher, E6165 Borley Rd., Coeur D' Alene, Id. 83814

[21] Appl. No.: 08/893,597

[22] Filed: Jul. 14, 1997

[51] Int. Cl.[6] ..... E21B 7/26

[52] U.S. Cl. ..... 175/20

[58] Field of Search ..... 175/23, 20, 246; 29/281.5, 234

[56] References Cited

U.S. PATENT DOCUMENTS

| | | | |
|---|---|---|---|
| 1,373,492 | 4/1921 | Dodds | 255/72 |
| 2,147,896 | 2/1939 | Harrington | 255/72 |
| 2,704,655 | 3/1955 | Stokes | 255/72 |
| 3,042,124 | 7/1962 | Andersson | 175/20 |
| 3,075,588 | 1/1963 | Mitchell | 175/20 |
| 3,367,188 | 2/1968 | Robinson | 73/425.2 |
| 3,429,387 | 2/1969 | Brown | 175/237 |
| 3,915,245 | 10/1975 | Tuccillo | 175/237 |
| 4,512,419 | 4/1985 | Rowley | 175/58 |
| 4,605,075 | 8/1986 | Radford et al. | 175/58 |
| 4,664,205 | 5/1987 | Knighton | 175/58 |
| 4,930,587 | 6/1990 | Young | 175/251 |
| 5,186,263 | 2/1993 | Kejr | 175/20 |
| 5,211,249 | 5/1993 | Richter | 175/20 |
| 5,474,140 | 12/1995 | Stevens | 175/20 |
| 5,542,481 | 8/1996 | Scott | 175/23 |

OTHER PUBLICATIONS

U.S. Statutory Invention Registration, Reg. #H1780. Melega, James L., "Soil Sample Core System" Feb. 1999.

*Primary Examiner*—William Neuder
*Assistant Examiner*—Zakiya Walker
*Attorney, Agent, or Firm*—David S. Thompson

[57] ABSTRACT

A soil sampling apparatus provides a drive shoe that is threadedly carried by the soil sampling tube. The drive shoe provides a hollow cylindrical body defining an internal flange extending radially inwardly. A pin point slides within the drive shoe and sample tube in the unlocked mode, when the soil sample is being taken, and is fixedly attached to the drive shoe in the locked mode, when the drive rod and attached soil sampling apparatus is driven to the depth where the soil sample is to be taken. Three collets are radially distributed about a wide neck portion of the pin point, and are supported by a shoulder portion of the pin point. Downward force on the drive rod results in downward movement of the drive shoe, causing the internal flange to push down on the collets, which in turn push down on a shoulder portion of the pin point, pushing the pin point deeper into the ground. To unlock the pin point at the desired depth, the drive rod is raised a couple inches and a rod is dropped through the drive rod, striking the top of the pin point, causing the collets to be moved radially inwardly against a narrow neck portion of the pin point, and out of contact with the flange of the drive shoe. Once the pin point is unlocked, downward force on the sampling tube causes the pin point to be raised upwardly, through the sampling tube, as the soil sample sample fills the tube.

2 Claims, 5 Drawing Sheets

SOIL SAMPLING APPARATUS

CROSS-REFERENCES

There are no applications related to this application filed in this or any foreign country.

BACKGROUND

The present invention relates in general to a locking device for a soil sampling apparatus. The structure of the device enables the unlocking of the nose after it has been driven to a desired depth, thereby allowing a sample to be taken beginning at the desired depth.

The need to obtain soil samples is present in many industries, particularly where investigation of hazardous waste is required. Prior art soil sampling apparatuses have disclosed a number of different structures to unlock the nose at a desired depth, and to thereby begin to take the soil sample. Some soil sampling apparatuses have to be unscrewed in order to begin to take the soil sample. This requires a long rod that extends from the surface to the nose of the soil sampling apparatus, and is susceptible to binding and other difficulties. Other soil sampling apparatuses have wires or fluids to release the nose at the desired depth, and have a variety of shortcomings.

What is needed is a soil sampling apparatus having a nose that is easily unlocked, without the requirement of wires, fluids, rods or other structures that will add to the complexity, cost, time and failure rate of the soil sampling apparatus.

SUMMARY

The present invention is directed to an apparatus that satisfies the above needs. The apparatus of the present invention provides some or all of the following structures.

(A) A drive shoe, releasably fastenable to the sample tube, having a cavity defining an internal flange and a collet groove.

(B) A pin point, in a locked mode is rigidly attached to the drive shoe, and in an unlocked mode is slidably carried within the drive shoe and sample tube. The pin point comprises:

(a) An upper portion having a threaded surface for attachment to an end cap.

(b) A narrow neck, extending downwardly from the upper portion, with sufficient length to provide relief for a basket lifter.

(c) A wide neck, extending downwardly from the narrow neck.

(d) A cylindrical body having an O-ring groove, extending downwardly from the wide neck.

(e) A tapered nose, extending downwardly from the cylindrical body.

(C) An end cap, carried by the upper portion of the pin point.

(D) Typically three collets, movable between a first position wherein the pin point is in a fixed or locked relationship with the drive shoe, and a second position wherein the pin point is slidable within the drive shoe and sample tube. In the first, locked, position, the collets are biased radially inwardly against the wide neck of the pin point by an nylon band, and are carried within the collet groove of the drive shoe. In the locked position, downward pressure on the drive shoe causes the drive shoe's internal flange to press on the top of the collets, causing the bottom of the collets to push on an annular lower shoulder surface of the pin point, thereby forcing the pin point downwardly and displacing the soil below. In the second position, the collets are biased against the narrow neck of the pin point and not carried within the collet groove of the drive shoe. This positioning of the collets allows the pin point to travel upwardly within the drive shoe and sample tube, as the sample tube is pressed downwardly, to gather the soil sample.

(E) A release bar, sized for movement within the bore of the sample tube to a position wherein the release bar is in contact with the pin point. The weight of the release bar, dropped on the pin point, causes the pin point to move downwardly. The collets, whose position is fixed within the collet groove of the drive shoe, slide along the wide neck of the pin point. As the wide neck of the pin point moves below the collet groove of the drive shoe, the collets snap radially inwardly into a position biased by the elastic nylon band against the narrow neck of the pin point, thereby unlocking the pin point.

It is therefore a primary advantage of the present invention to provide a novel soil sampling apparatus having a pin point and a drive shoe that are lockable in a fixed relationship for insertion into the soil, and easily unlockable from the surface.

Another advantage of the present invention is to provide a plurality of collets that are movable from a first position radially biased inwardly against a lower wide neck of a pin point to a second position radially biased inwardly against an upper narrow neck of the pin point without the need to use control rods, wires or threaded stop pins.

A still further advantage of the present invention is to provide a soil sampling apparatus that is easily and inexpensively manufactured, and is extremely reliable.

DRAWINGS

These and other features, aspects, and advantages of the present invention will become better understood with regard to the following description, appended claims, and accompanying drawings where:

DESCRIPTION

Figure 1:
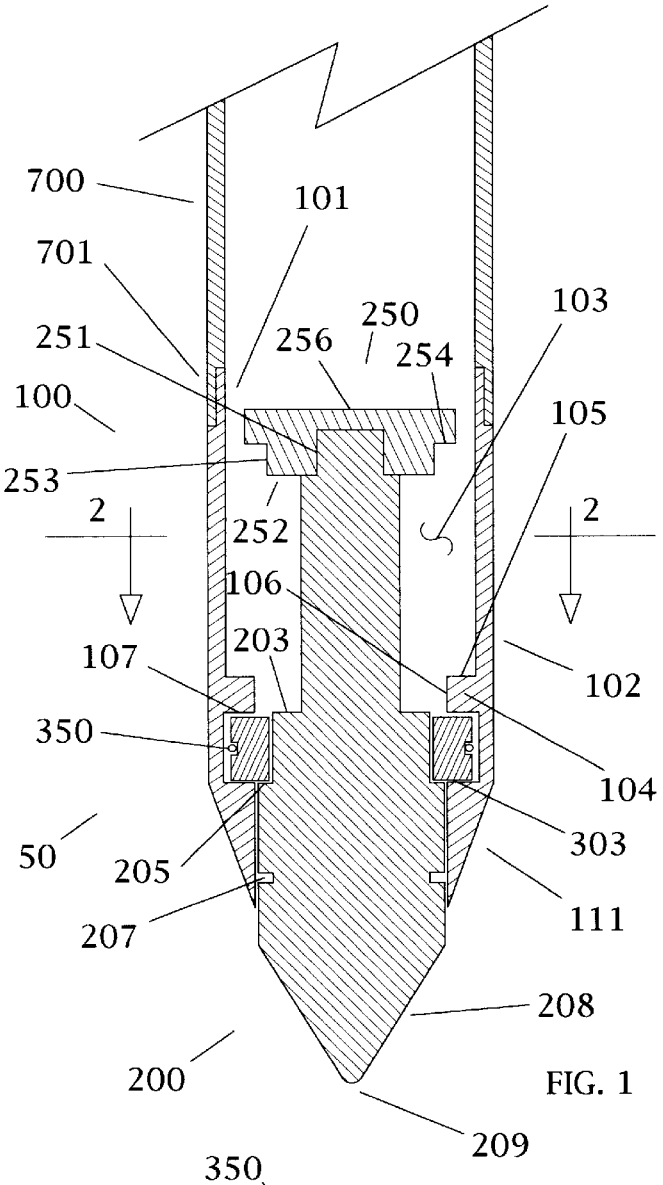
FIG. 1 is a cross-sectional view of a version of the invention, showing the sample tube connected to the drive shoe, with the collets radially biased to the lower wider neck of the pin point, thereby preventing upward motion of the pin point with respect to the drive shoe as the drive shoe is forced downwardly by the sample tube.

Referring in generally to FIGS. 1 through 4, a soil sampling apparatus 50 constructed in accordance with the principles of the invention is seen. The soil sampling apparatus provides a drive shoe 100 which attaches to the sample tube 700, and a pin point 200 which is releasably lockable to the drive shoe. Three collets 300 are carried by the pin point in either a first position, which causes the pin point to be rigidly locked to the drive shoe, or a second position, which allows the sample tube to be lowered, and for the soil sample to push the pin point upwardly, through the drive shoe and the sample tube.

Figure 3:
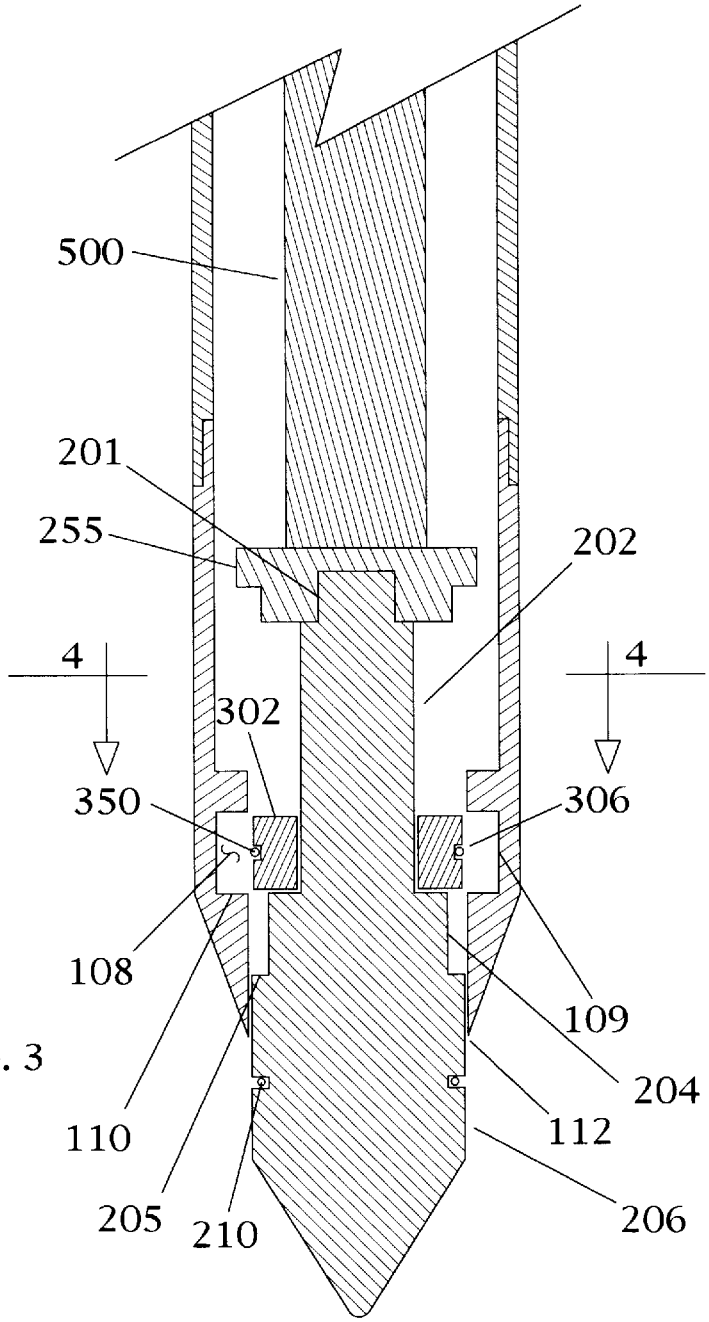
FIG. 3 is a cross-sectional view of the version of the invention of FIG. 1, wherein the release bar has pushed the pin point downwardly, causing the collets to be moved from the position biased against the wide neck to a position biased against the narrow neck.

As seen in FIGS. 1 and 3, a sample tube 700 is of any conventional type, typically having a threaded lower portion 701, which is releasably fastenable to the drive shoe 100 of the soil sampling apparatus 50 of the invention.

The drive shoe 100 provides an upper threaded surface 101, which may be attached to the threaded lower portion 701 of the sample tube. A hollow cylindrical body 102 defines an internal cavity 103. A flange 104 extends radially inwardly from the body 102, and is defined by an annular upper surface 105, a cylindrical sidewall surface 106, and an annular lower surface 107. A collet groove 108 is adjacent to and below the flange 104, and provides a cylindrical sidewall surface 109 and an annular lower surface 110. Because the internal flange 104 and the collet groove 108 are adjacent, the annular lower surface 107 of the internal flange defines the upper edge of the collet groove.

As seen in FIGS. 1 and 3, a tapered lower end 111 allows easier insertion of the soil sampling apparatus into the soil, while a lower opening 112 allows the soil sample to enter the sample tube, when the pin point is released.

A pin point 200 slides within the drive shoe 100 and sample tube 700 in the unlocked mode, when the soil sample is being taken, and is fixedly attached to the drive shoe in the locked mode, when the drive tube and attached soil sampling apparatus is driven to the depth where the soil sample is to be taken. The pin point provides a threaded upper neck 201 which may be attached to the end cap 250, as will be seen.

A narrow neck 202 has a diameter that is sized to allow clearance passage of the pin point through the drive shoe and sample tube when the collets are grouped about the narrow neck, as seen in FIG. 3. More specifically, the diameter of the narrow neck is sized such that when the collets are grouped about it, as seen in FIGS. 3 and 4, the collets will pass through the internal flange 104 without binding or catching.

Figure 4:
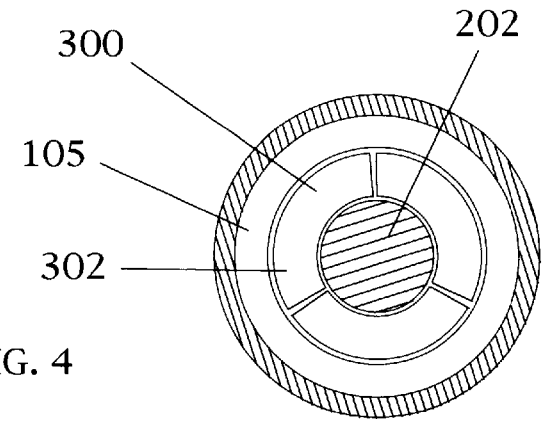
FIG. 4 is a cross-sectional view of the drilling apparatus of FIG. 3, showing the collets gathered about the narrow neck.

When the collets are in the unlocked position, as seen in FIGS. 3 and 4, they are supported by the upper shoulder 203, which is an annular surface that is generally perpendicular to the narrow neck 202.

Figure 2:
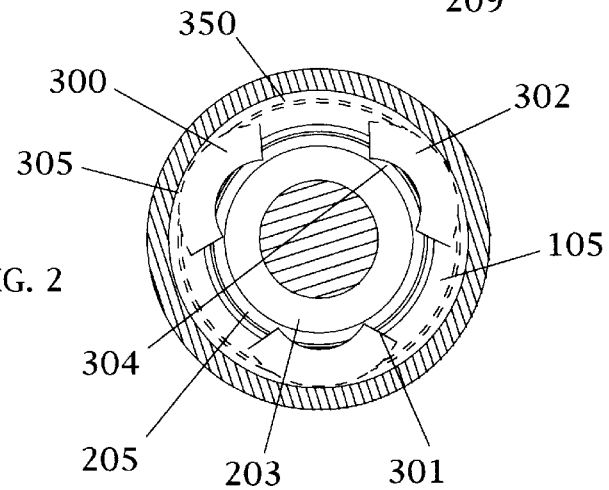
FIG. 2 is a slightly enlarged cross-sectional view of the version of the invention of FIG. 1, taken along the 2—2 lines, showing the collets distributed about the wide neck of the pin point.

A wide neck 204 is greater in diameter than the narrow neck 202, as seen in FIGS. 1 and 3. The wide neck has a diameter that is sized such that when the collets are grouped about it, as seen in FIGS. 1 and 2, the collets will be carried within the collet groove 108, adjacent to the internal flange 104 and adjacent to the lower shoulder 205 of the pin point.

The pin point also provides a cylindrical body 206 having an O-ring groove 207 that may carry an O-ring 210 which tends to prevent soil from entering the soil sampling apparatus as it is pounded to the depth from which the soil sample will be taken.

A tapered nose 208 having a point 209, carried by a lower portion of the cylindrical body 206, allows the pin point to be more efficiently driven into soil.

An end cap 250 is releasably attachable by fastening means to the upper end of the pin point, as seen in FIGS. 1 and 3. The end cap is typically round when viewed from the top, and should have a diameter that will prevent the pin point from moving through the drive shoe. As seen in FIGS. 1 and 3, the diameter of the cylindrical sidewall surface 106 of the internal flange 104 is less than the diameter of the end cap, thereby preventing the end cap, and attached pin point, from passing through the flange 104.

The end cap typically provides internal threads 251 which are sized to fit the upper threaded surface 101 of the drive shoe 100. A lower shoulder 252 is an annular surface adjacent to a lower cylindrical sidewall 253, which typically has a diameter incrementally less than the diameter of the cylindrical sidewall surface 106 of the flange 104, thereby allowing passage of the sidewall 253 adjacent to the flange. An upper shoulder 254 is sized to contact the annular upper surface 105 of the flange 104, if the end cap is lowered against the flange. An upper cylindrical sidewall 255 is greater in diameter than the cylindrical sidewall surface 106, thereby preventing the end cap from passing through the flange 104. A circular upper surface 256 is suitable for contact with the release bar 500, as seen in FIG. 3.

FIGS. 1–4 illustrates a preferred embodiment of the invention, having three collets 300 are radially distributed about either the narrow neck portion 202 or the wide neck portion 204 of the pin point 200. A greater or lesser number of collets may function similarly; however three collets is generally preferable. The collets function by moving between a first position, wherein the downward force of the drive shoe 100 is transferred through the collets to the pin point, and a second position, wherein the pin point is released from the drive shoe.

Each collet provides an end surface 301, an upper surface 302 and a lower surface 303. The inner cylindrical surface 304 and the outer cylindrical surface 305 are similarly curved in a manner calculated to allow the collets to be grouped about the narrow neck 202, as seen in FIG. 4.

An elastic band groove 306 is formed in the outer cylindrical surface 305, allowing an elastic band 350 to be used to bias the collets radially inwardly against the narrow neck 202 or the wide neck 204 of the pin point 200.

In a preferred embodiment, the upper and lower surfaces 302, 303 are separated by approximately 0.5 inches, and the inner and outer cylindrical surfaces 304, 305 are separated by 0.25 inches. The elastic band groove 306 is approximately 0.075 inches in width.

Figure 7:
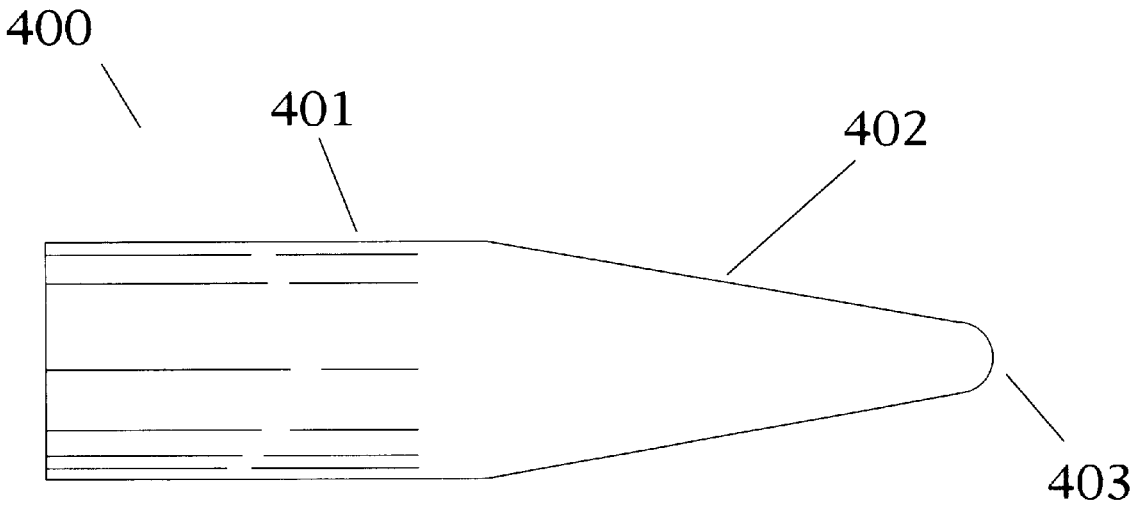
FIG. 7 is a side view of the loading tool.
Figure 8:
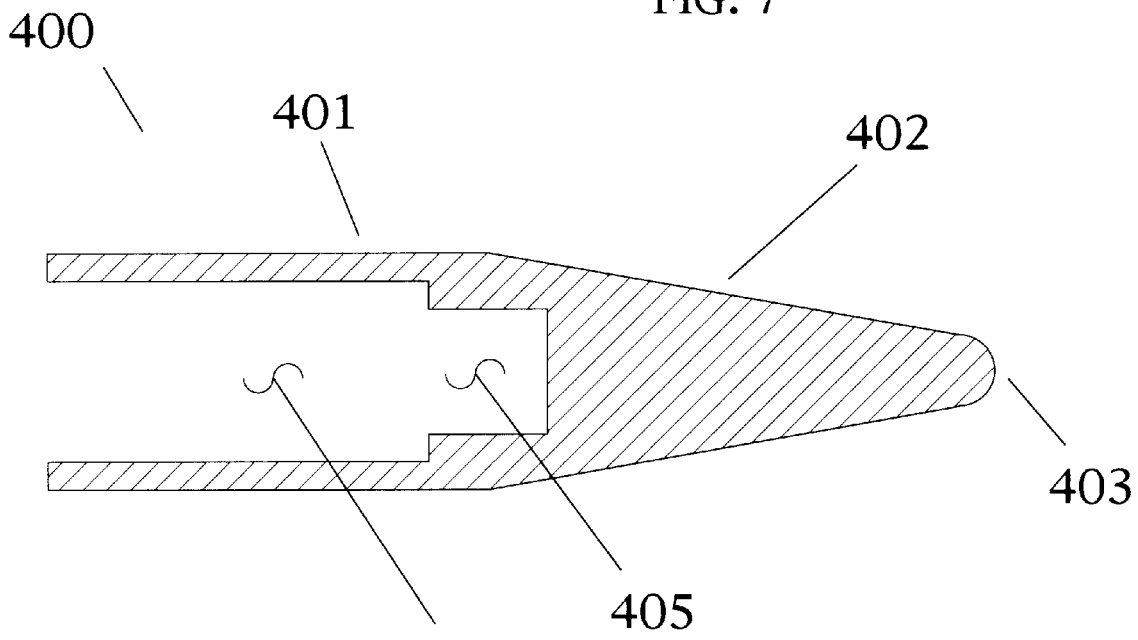
FIG. 8 is a side cross-sectional view of the loading tool.

A loading tool 400 is seen in FIGS. 7 and 8. The loading tool allows the collets 300 to be arranged around the wide neck 204 of the pin point 200, as seen in FIG. 1. Referring particularly to FIG. 7, the loading tool provides a cylindrical body 401 having approximately the same outside diameter as the wide neck 204 of the pin point. A tapered front end 402 terminated in a rounded point 403. Referring next to FIG. 8, an interior channel 404 has an inside diameter incrementally greater than the outside diameter of the narrow neck 202 of the pin point 200. A cylindrical recess 405 is sized incrementally greater than the threaded upper neck 201 of the pin point.

A release bar 500, seen in FIG. 3, allows the user to unlock the pin point from the drive shoe from the surface of the ground, after the drive shoe, pin point and sample tube have been driven to the depth at which the soil sample to be taken is to be started. An essential characteristic of the release bar 500 is that is should be sized for easy travel within the sample tube 700.

Figure 9:
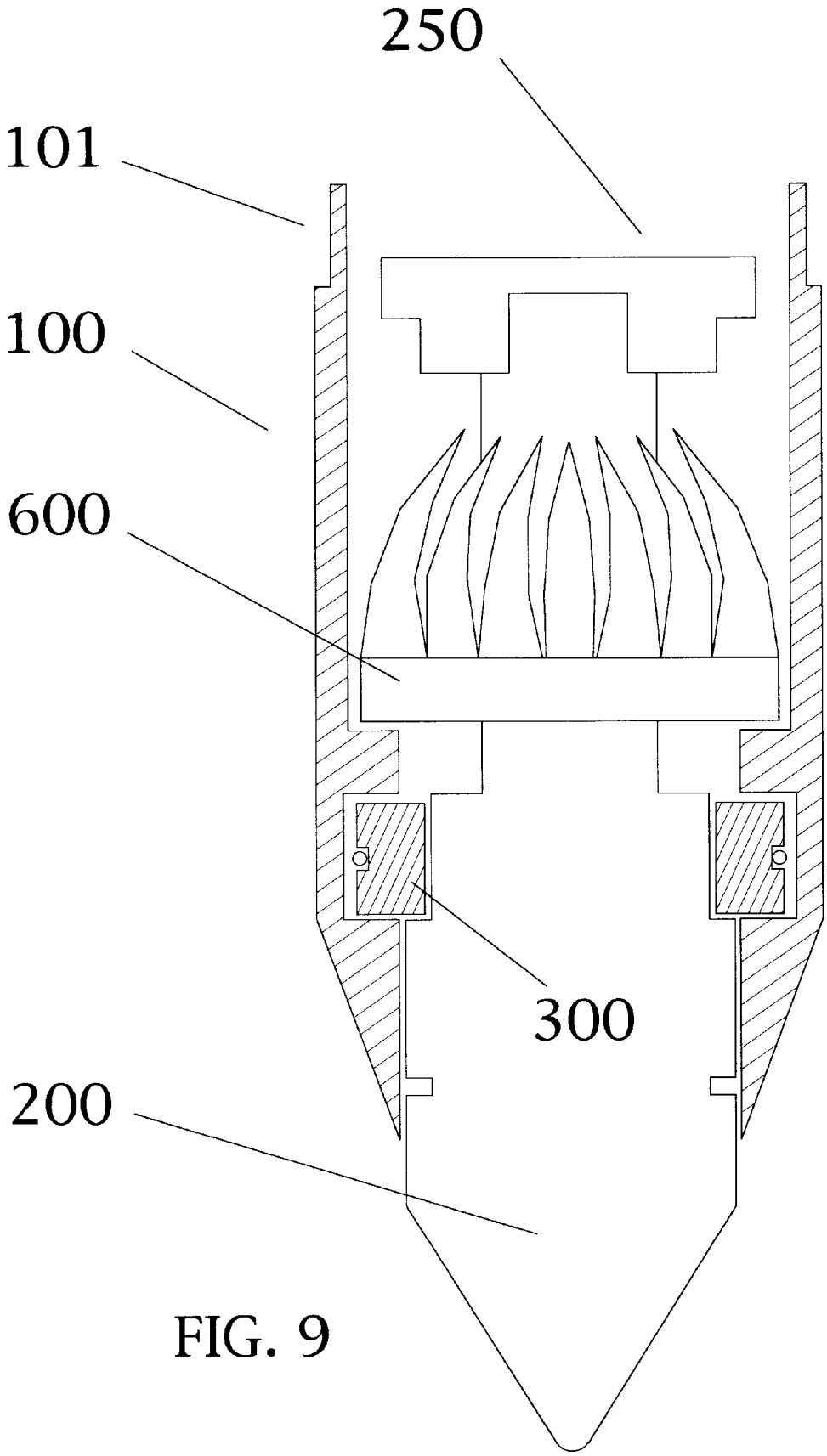
FIG. 9 is a side cross-sectional view of the apparatus of FIG. 1, showing the installation of a basket retainer.

As seen in FIG. 9, a basket retainer 600 allows sample soil to pass upwardly through the sample tube 700, but prevents the sample from moving downwardly. Known types of basket retainers may be supported by the annular upper surface 105 of the internal flange 104 of the drive shoe 100.

To use the soil sampling apparatus of the invention, the user first arranges the three collets in a circular manner, so that the end surfaces 301 of adjacent collets are touching. The elastic nylon band 350 is then positioned in the elastic band groove 306 of the collets, biasing the collets radially inward.

The rounded point 403 of the loading tool 400 is then inserted into the center of the collets. The collets are manually slid part of the way up the tapered front end 402, which causes the individual collets to move apart slightly, and for the elastic nylon band to stretch slightly. The collets are not slid as far as the cylindrical body 401 of the loading tool.

The rounded point 403 of the loading tool is then inserted into the lower opening 112 of the drive shoe 100. The collets are moved up the internal cavity 103 of the drive shoe until the upper surface 302 of the collets contacts the annular lower surface 107 of the internal flange 104 of the drive shoe. At this point, the collets cannot be pushed further into the drive shoe, and assume a position within the collet groove 108. As a result, as the loading tool is pushed further up the drive shoe, the collets slide against the cylindrical body of the loading tool. Because the collets are pushed radially outwardly by the loading tool, and are carried by the cylindrical body of the loading tool, the collets are trapped within the collet groove.

Figure 5:
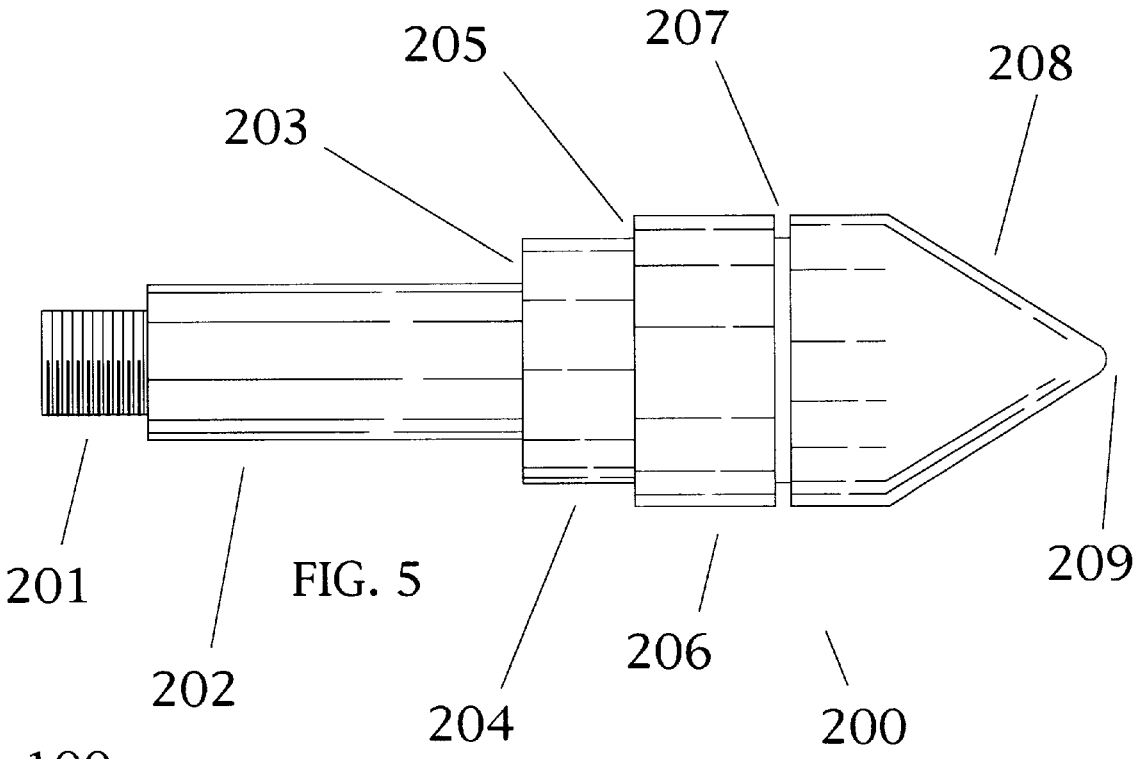
FIG. 5 is a side view of the pin point.
Figure 6:
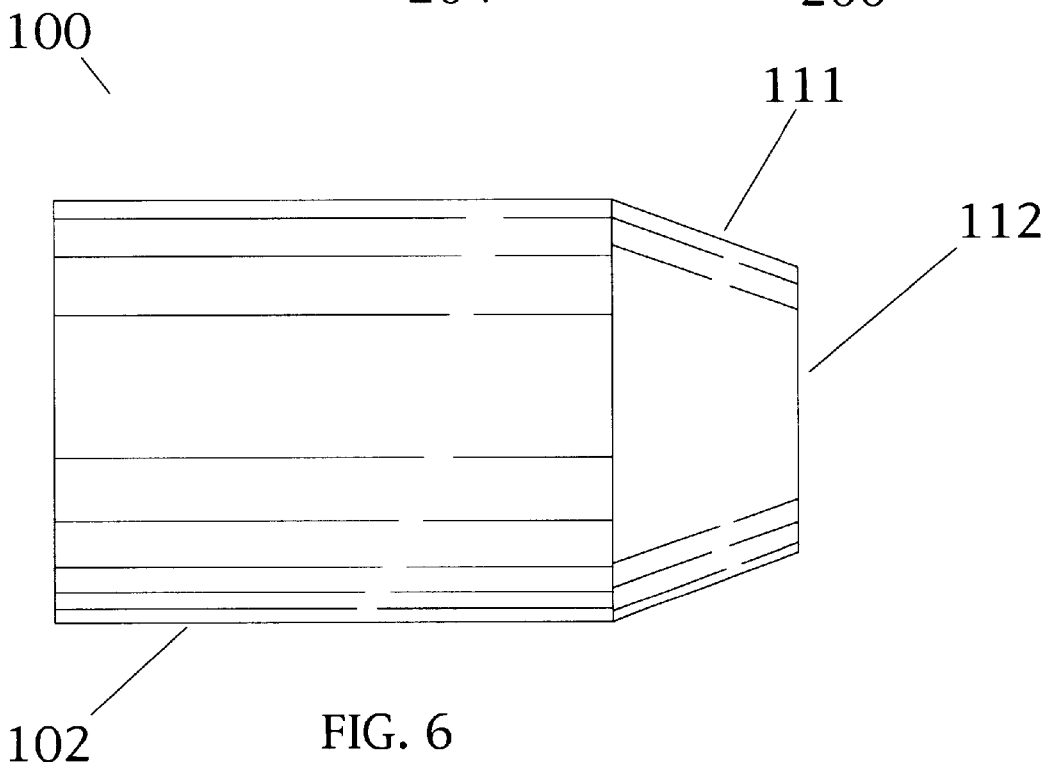
FIG. 6 is a side view of the drive shoe.

The threaded upper neck 201 and the narrow neck 202 of the pin point 200 are then inserted into the interior channel 404 of the loading tool. A comparison of FIGS. 5 and 8 reveal how the threaded neck 201 and the narrow neck 202 of the pin point 200 fit into the interior of the loading tool, and how the cylindrical body of the loading tool is flush with the wide neck of the pin point.

The collets, whose position is fixed within the collet groove, then slide against the cylindrical body 401 of the loading tool, as the loading tool and attached pin point are moved upwardly, until the collets slide off the loading tool and onto the wide neck 204 of the pin point 200.

The loading tool is then separated from the pin point, and the loading tool is moved further up and out of the drive shoe. The bring 210 of the pin point tends to keep the pin point frictionally engaged to the drive shoe. The loading tool and pin point separate, with the loading tool being removed from the drive shoe, and the pin point remaining within the drive shoe, with the collets arranged much as seen in FIG. 1.

The end cap 250 may then be screwed onto the threaded upper neck 201 of the pin point. The drive shoe 100 may then be threaded onto the threaded lower end 701 of the sample tube 700. Some care should be taken to support the bottom point 209 of the pin point, so that the weight of the pin point will not cause the pin point to move relative to the drive shoe, with the result being the collets moving from a position biased against the wide neck to a position biased against the narrow neck. However, the O-ring 210 tends to provide a frictional connection between the pin point and the drive shoe that reduces movement between the two, helping to prevent the unwanted unlocking of the collets.

The sample tube may then be driven into the soil, to a depth at which the sample is to begin. As the sample tube is driven downwardly, force on the drilling tube results in downward movement of the drive shoe, causing the internal flange 104 to push down on the upper surface 302 of the collets. The lower surface 303 of the collets in turn pushes down on the lower shoulder 205 of the pin point 200, pushing the pin point deeper into the ground.

At the depth at which the soil sample is to begin, the soil sampling apparatus is unlocked. To unlock the pin point 200, the sample tube 700 is first raised a couple inches. This allows room for the pin point to fall. The release bar is then dropped through the sample tube, striking the top of the end cap 250 carried by the pin point, causing the pin point to fall about two inches. As a result, the collets, trapped between annular surfaces 107 and 110, slide against the wide neck 204, as the wide neck moves down, and as the pin point falls the approximately two inches.

As the upper shoulder 203 passes beneath the annular lower surface 110 of the collet groove 108, the collets snap into position around the narrow neck 202, as seen in FIGS. 3 and 4. The elastic nylon band 350 biases the collets around the narrow neck 202.

At this point, downward force on the sample tube causes the pin point to be pushed upwardly, through the soil sampling tube, as the soil sample fills the tube.

The previously described versions of the present invention have many advantages, including a primary advantage of providing a novel soil sampling apparatus having a pin point and a drive shoe that are lockable in a fixed relationship for insertion into the soil, and easily unlockable from the surface.

Another advantage of the present invention is to provide a plurality of collets that are movable from a first position radially biased against a lower wide neck of a pin point to a second position radially biased against an upper narrow neck of the pin point without the need to use control rods, wires or threaded stop pins.

A still further advantage of the present invention is to provide a soil sampling apparatus that is easily and inexpensively manufactured, and is extremely reliable.

Although the present invention has been described in considerable detail and with reference to certain preferred versions, other versions are possible. For example, the number of collets could be increased or decreased. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A soil sampling apparatus for attachment to a sample tube, comprising:

(A) a drive shoe, releasably fastenable to the sample tube, having a cavity defining an internal flange and a collet groove;

(B) a pin point, slidably carried within the drive shoe, comprising:

(a) a narrow neck; and (b) a wide neck, attached to the narrow neck;

(C) at least two collets, movable from a first position biased against the wide neck and carried within the collet groove, to a second position, biased against the narrow neck; and (D) a release bar, sized for movement within the sample tube to a position wherein the release bar is in contact with the pin point; and (E) an end cap, carried by a threaded upper neck of the pin point, the threaded upper neck adjacent to the narrow neck.

2. A loading tool and a soil sampling apparatus for attachment to a sample tube, comprising:

(A) a drive shoe, releasably fastenable to the sample tube, having a cavity defining an internal flange and a collet groove;

(B) a pin point, slidably carried within the drive shoe, comprising:

(a) a threaded upper neck;

(b) a narrow neck, having opposed first and second ends, the first end attached to the threaded upper neck;

(c) a wide neck, attached to the second end of the narrow neck;

(d) a cylindrical body having an O-ring groove, attached to the wide neck; and (e) a tapered nose, attached to the cylindrical body;

(C) an end cap, carried by the threaded upper neck;

(D) at least two collets, movable from a first position biased against the wide neck and carried within the collet groove, to a second position, biased against the narrow neck;

(E) a release bar, sized for movement within the sample tube to a position wherein the release bar is in contact with the pin point; and (F) a loading tool, sized for passage through the cavity defined within the drive shoe, comprising:

(a) a cylindrical body having a tapered front;

(b) an interior channel sized to carry the narrow neck of the pin point; and (c) a recess, adjacent to the interior channel, sized to carry the threaded upper neck of the pin point.

* * * * *